United States Patent [19]

Akesaka

[11] Patent Number: 4,869,619

[45] Date of Patent: Sep. 26, 1989

[54] METHOD FOR EXCAVATING HOLE AND APPARATUS THEREFOR

[75] Inventor: Toshio Akesaka, Yokohama, Japan

[73] Assignee: Kabushiki Kaisha Iseki Kaihatsu Koki, Tokyo, Japan

[21] Appl. No.: 225,181

[22] Filed: Jul. 28, 1983

[30] Foreign Application Priority Data

Oct. 20, 1987 [JP] Japan ..... 62-262815

[51] Int. Cl.[4] ..... T16L 1/02

[52] U.S. Cl. ..... 405/184; 175/53; 175/61; 405/154

[58] Field of Search ..... 405/154, 184; 175/61, 175/62, 75, 78, 79, 82; 138/97

[56] References Cited

U.S. PATENT DOCUMENTS

| | | | |
|---|---|---|---|
| 3,354,969 | 11/1967 | Ebeing | 175/62 |
| 4,091,631 | 5/1978 | Cherrington | 405/184 |
| 4,619,555 | 10/1986 | Skinner et al. | 138/97 X |
| 4,699,224 | 10/1987 | Burton | 175/61 |
| 4,762,186 | 8/1988 | Deeh et al. | 175/61 |
| 4,784,230 | 11/1988 | Cherrington et al. | 175/61 |

*Primary Examiner*—Randolph A. Reese
*Assistant Examiner*—Arlen L. Olsen
*Attorney, Agent, or Firm*—Mattern, Ware, Stoltz & Fressola

[57] ABSTRACT

A method for excavating a hole and an apparatus therefore are suitable for the operation of excavating a hole used for laying a lateral sewer or mounting pipe, which extends from a main sewer pipe toward the ground surface, on the main sewer pipe. The method comprises the step of rotating a rod about its axis in a space provided in the ground while advancing the rod in the direction of penetrating a wall member defining the space, and the step of utilizing the advanced rod as a guide while excavating a hole in the ground from the tip end of the rod toward the space. The apparatus embodying the method described above comprises a rod propelling machine disposed in a space provided in the ground for rotating a rod about its axis while advancing the rod and a excavating machine utilizing the advanced rod as a guide while excavating a hole in the ground from the tip end of the rod toward the space. The rod propelling machine includes an operating mechanism for rotating the rod about its axis while advancing the rod and a guide mechanism which is placed in front of the operating mechanism for guiding the rod in the direction of penetrating a wall member of the pipe which defines the space.

13 Claims, 8 Drawing Sheets

METHOD FOR EXCAVATING HOLE AND APPARATUS THEREFOR

BACKGROUND OF THE INVENTION

1. Field of the Invention:

This invention relates to a method for excavating a hole in the ground and an apparatus therefor and, more particularly, to a method and an apparatus suitable for the operation of excavating a hole used for laying a lateral sewer or mounting pipe, which extends from a main sewer pipe toward the surface of the ground, on the main sewer pipe.

2. Description of the Prior Art:

One method for laying a branch pipe or mounting pipe for sewage the comprises the steps of excavating a ditch by the open cut method, positioning the mounting pipe in the excavated ditch and then connecting the mounting pipe to a main pipe provided in the ground. The method noted above, however, cannot be applied to locations which cannot be excavated by the open cut method.

A different method for laying a sewage mounting pipe comprises the steps of excavating a hole from the ground surface to the main pipe by an excavating machine such as an earth auger and then positioning the mounting pipe in the hole. According to this method, however, the hole is formed by excavating the ground from the ground surface to the main pipe provided in the ground, so that the tip of the excavated hole often deviates from the position where the main pipe is embedded and, as a result, the mounting pipe cannot be accurately laid.

SUMMARY OF THE INVENTION

An object of the present invention is to provide a method for excavating a hole and an apparatus therefor, which can easily and accurately excavate a hole even in a location incapable of being excavated by an open cut method.

A method for excavating a hole according to the present invention comprises the step of rotating a rod about its axis in a space provided in the ground while advancing the rod to penetrate a wall member defining the space and the step of utilizing the advanced rod as a guide while excavating a hole in the ground from the tip end of the rod toward the space.

An apparatus for excavating a hole according to the present invention comprises a rod propelling machine disposed in a space provided in the ground and for rotating the rod about its axis while advancing the rod and an excavating machine utilizing the advanced rod as a guide while excavating a hole in the ground from the tip side of the rod toward the space, wherein the rod propelling machine is provided with operating means for rotating the rod about its axis while advancing the rod and rod guiding means placed in front of the operating means and for guiding the rod in the direction of penetrating a wall member defining the space.

The rod propelling machine comprises operating means for clamping the rod and rotating the rod about its axis while advancing the rod, means for guiding the rod along a curved path and means for supporting the operating means and guide means.

The excavating machine according to the present invention utilizes the rod extending from the space provided in the ground as a guide while excavating a hole in the ground from the tip end of the rod toward the space, and comprises means for clamping the tip of the rod, excavating means disposed coaxially with the rod to extend along the rod, drive means for rotating the excavating means around the rod while advancing the excavating means along the rod and means for supporting the clamping means, excavating means and drive means.

According to the present invention, since a hole is excavated from the tip end of the rod toward the space while utilizing the rod extending from the space provided in the ground as a guide, it is possible to excavate the hole accurately and easily even in locations incapable of being excavated by the driving method.

According to the apparatus for excavating a hole of the present invention, the rotated and advanced rod is guided in the direction of penetrating the wall member defining the space. Therefore, when the space is elongated like a pipeline, the hole can be excavated so as to extend in the direction intersecting the extending direction of the space.

According to the rod propelling machine of the present invention, since the guide means guides the rod along the curved path, the guide means does not hinder the rotation and advance of the rod.

According to the excavating machine of the present invention, since the excavating means is advanced along the rod while being clamped to the rod, the hole can be excavated accurately.

BRIEF DESCRIPTION OF THE DRAWINGS

The foregoing and other objects and features of the invention will become apparent from the following description of a preferred embodiment of the invention with reference to the accompanying drawings, in which.

DETAILED DESCRIPTION OF THE PREFERRED EMBODIMENT

Figure 1:
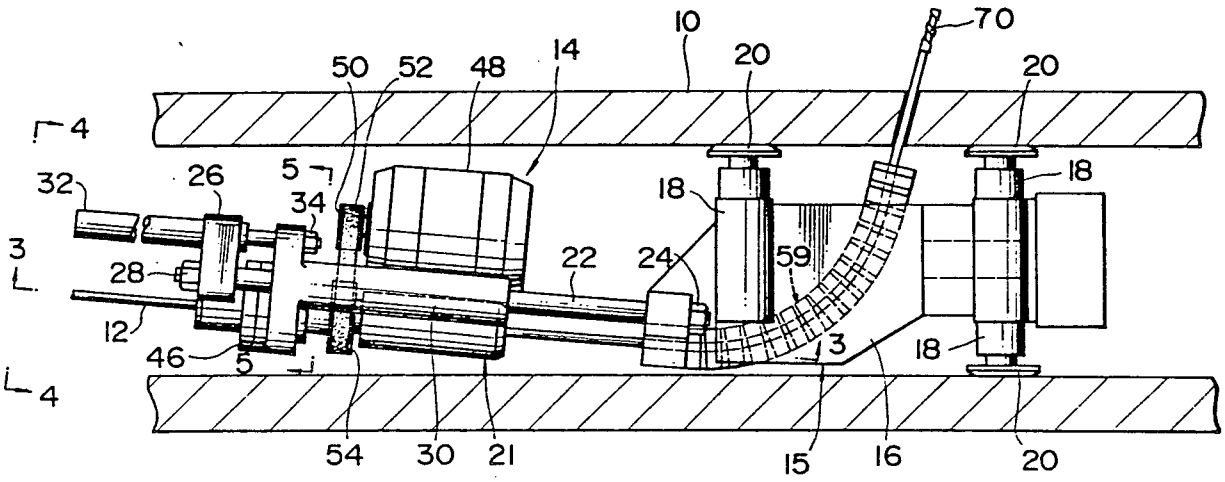
FIG. 1 is a front view showing an embodiment of a rod propeller used in the present invention.

Referring to FIG. 1, a rod propelling machine or rod propeller 14 for rotating a flexible rod 12 such as an oil-tempered wire about its axis while advancing the same is disposed in a main sewer pipe 10 embedded in the ground. The rod propeller 14 comprises a support mechanism 15 for supporting respective mechanisms of the rod propeller.

The support mechanism 15 is provided with a base member 16 extending along the main pipe 10 and a plurality of jacks 18 disposed in spots longitudinally spaced apart from each other on the base member 16 so as to maintain the base member 16 in a fixed state relative to the main pipe 10. The jacks 18 are disposed at positions angularly spaced apart from each other about the axis of the main pipe 10 and extend radially of the main pipe 10. On the tip of a rod of each jack 18 is mounted a pad 20 pressed against the inner surface of the main pipe 10 when the jack is expanded.

An operating mechanism 21 for rotating the rod 12 about its axis while advancing the same is supported by the base member 16. As shown in FIGS. 1 to 5, the operating mechanism 21 is provided with a pair of rod-like guides 22 extending backwardly along the rod 12 in the main pipe 10 from the rear end of the base member 16 so that they are parallel with each other. The tip of each guide 22 is secured to the base member 16 by a nut 24. The rear end of each guide 22 is secured by a nut 28 to a connecting piece 26 for interconnecting both guides 22 so as to prevent their relative positional relationship from changing.

A slider 30 of the operating mechanism 21 is supported by the guides 22 so as to be slidable along the guides 22. The slider 30 has through holes for slidably receiving the guides 22 and is connected to a jack for moving slides 30 back and forth the along the guides 22. A cylinder of the jack 32 is secured to the connecting piece 26 so as to extend backwardly from the slider 30. A rod of the jack 32 is secured to the slider 30 by a nut 34.

Figure 2:
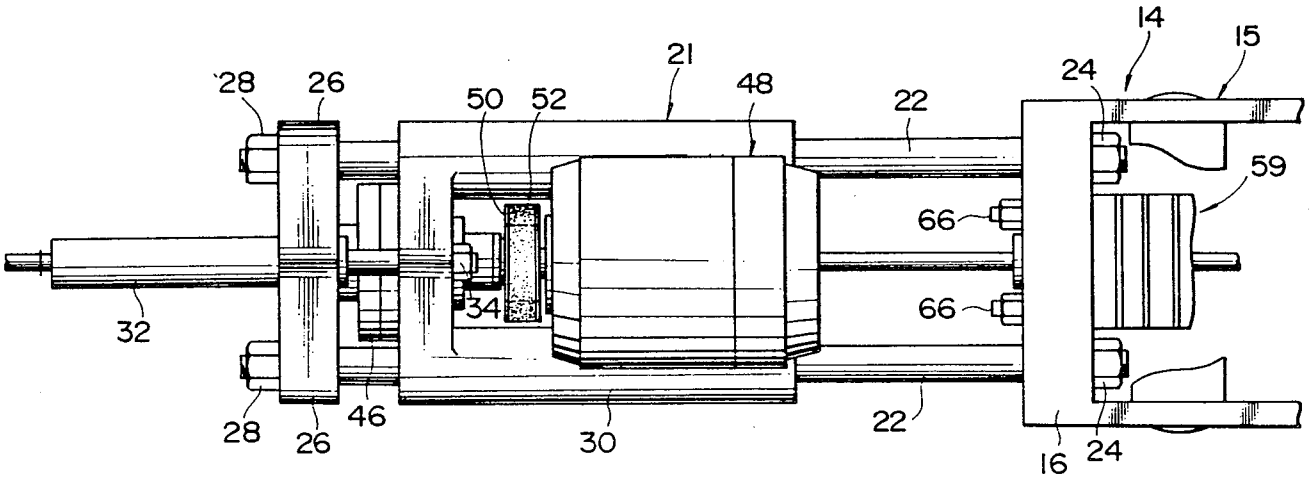
FIG. 2 is a enlarged-scale plan view showing a portion of an operating mechanism of the rod propelling machine shown in FIG. 1.
Figure 3:
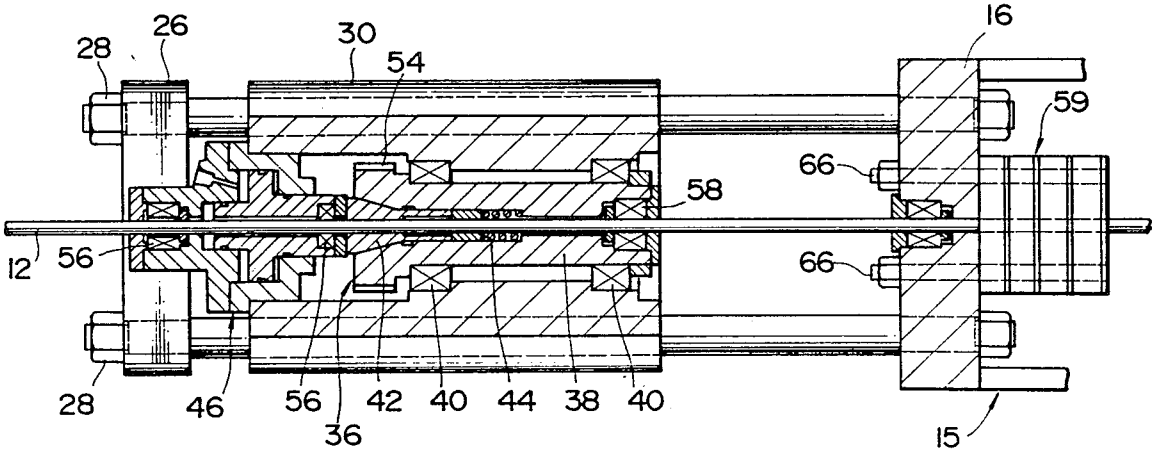
FIG. 3 is an enlarged-scale sectional view taken along the line 3—3 in FIG. 1.
Figure 4:
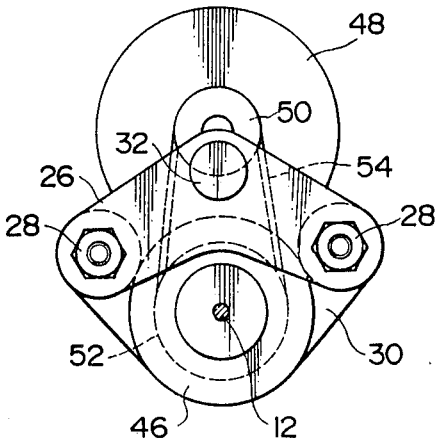
FIG. 4 is an enlarged-scale sectional view taken along the line 4—4 in FIG. 1.
Figure 5:
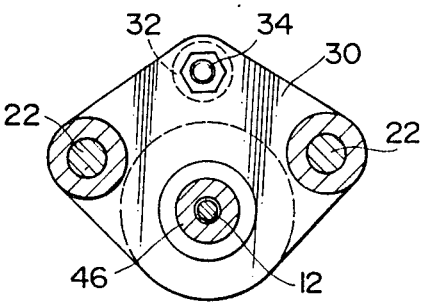
FIG. 5 is an enlarged-scale sectional view taken along the line 5—5 in FIG. 1.

As shown in FIGS. 2 and 3, the slider 30 is provided with a space which extends through the slider 30 along the rod 12. In the space of the slider 30 is disposed a chuck 36 of the operating mechanism 21 so that the chuck is rotatable about the axis of the rod 12 while being clamped to the rod. A chuck body 38 of the chuck 36 is rotatably supported by the slider 30 through a plurality of bearings 40.

The chuck body 38 is provided with a through hole for slidably receiving the rod 12. The tip of the through hole is a hole of such a small bore as to form a slight gap between the chuck body 38 and the rod 12. On the contrary, a central portion of the through hole constitutes a space larger than the hole of the small bore. Also, the rear end of the through hole constitutes a conical space. In the conical space at the rear end of the through hole are disposed a plurality of clamping claws 42 movable along the rod 12.

As seen in FIG. 3, the respective claws 42 are subjected to force for protruding the claws 42 from the central space, i.e., force for releasing the rod 12 from the clamping claws 42, by a coiled spring 44 disposed in the central space. Also, a cylinder mechanism 46 for advancing the respective claws 42 relative to the chuck body 38 is supported by the chuck body 38.

The slider 30 supports a motor 48 for rotating the chuck body 38. As shown in FIGS. 1 and 2, rotation of the motor 48 is transmitted to the chuck body 38 through a gear-like timing pulley 50 mounted on the rotary shaft of the motor 48, a timing belt 52 trained over the timing pulley 50 and a timing pulley 54 provided on the chuck body 38 to mesh with the timing belt 52.

As shown in FIG. 3, the rod 12 extends rotatably slidably through the cylinder mechanism 46. Thus, the cylinder mechanism 46 is provided with a plurality of bearings 56 for receiving rotatably slidable rod 12. The chuck body 38 is also provided with a bearing 58 for receiving rotatably slidably rod 12.

The base member 16 supports a guide mechanism 59 for guiding rod 12 along the curved path. The rod is rotated by the operating mechanism 21 while being drawn out along the axis of the main pipe 10.

Figure 6:
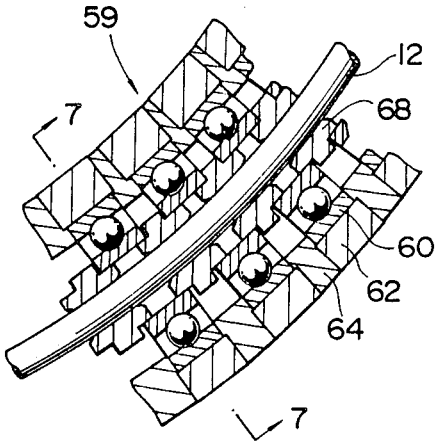
FIG. 6 is a sectional view showing an embodiment of a guide mechanism used in the rod propeller shown in FIG. 1.
Figure 7:
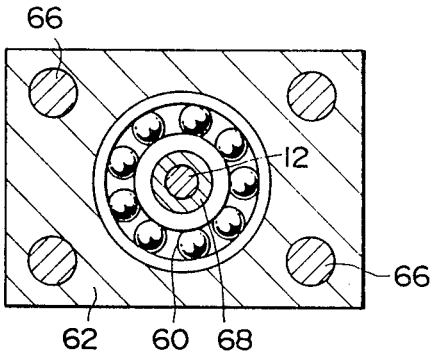
FIG. 7 is a sectional view taken along the line 7—7 in FIG. 6.

As shown in FIGS. 6 and 7, the guide mechanism 59 is provided with a plurality of bearings 60 which are respectively fitted in holes bored in the central portions of square plates 62. Also, the respective bearings 60 are sequentially disposed between spacers 64 so that the rotary centers of the bearings are disposed along a curve having a predetermined radius of curvature. Each plate 62 and spacer 64 is interconnected fixedly to each other by a plurality of bolts 66 extending along the curved paths. In the adjacent bearings 60 are respectively fitted rings 68, through which the rod 12 extends rotatably slidably.

At the time of propelling the rod, the rod 12 is passed from the operating mechanism 21 to the guide mechanism 59 and a drill 70 is mounted on the tip of the rod 12.

Then, the rod propeller 14 is disposed in a predetermined spot in the main pipe 10 by pushing the rod propeller 14 by a predetermined distance from one vertical shaft or manhole communicating to the main pipe 10 to the other, or by inserting a wire extending from one manhole to the other into the main pipe 10, connecting the rod propeller 14 to one end of the wire and then drawing the wire toward the other end thereof by a predetermined length.

Next, the rod propeller 14 is secured to the main pipe 10 by expanding the jacks 18 to the support mechanism 15. Subsequently, the motor 48 is rotated, and the jack 32 is repetitively expanded and contracted in synchronism with the operation of the cylinder mechanism 46. That is, the cylinder mechanism 46 is expanded while the jack 32 is expanded, and the cylinder mechanism 46 is contracted while the jack 32 is contracted.

Accordingly, the slider 30 reciprocates back and forth. Also, the chuck 36 reciprocates back and forth along with reciprocation of the slider 30. Further, the chuck 36 clamps the rod 12 at the time of advancing and releases the rod 12 at the time of retreating.

Figure 8:
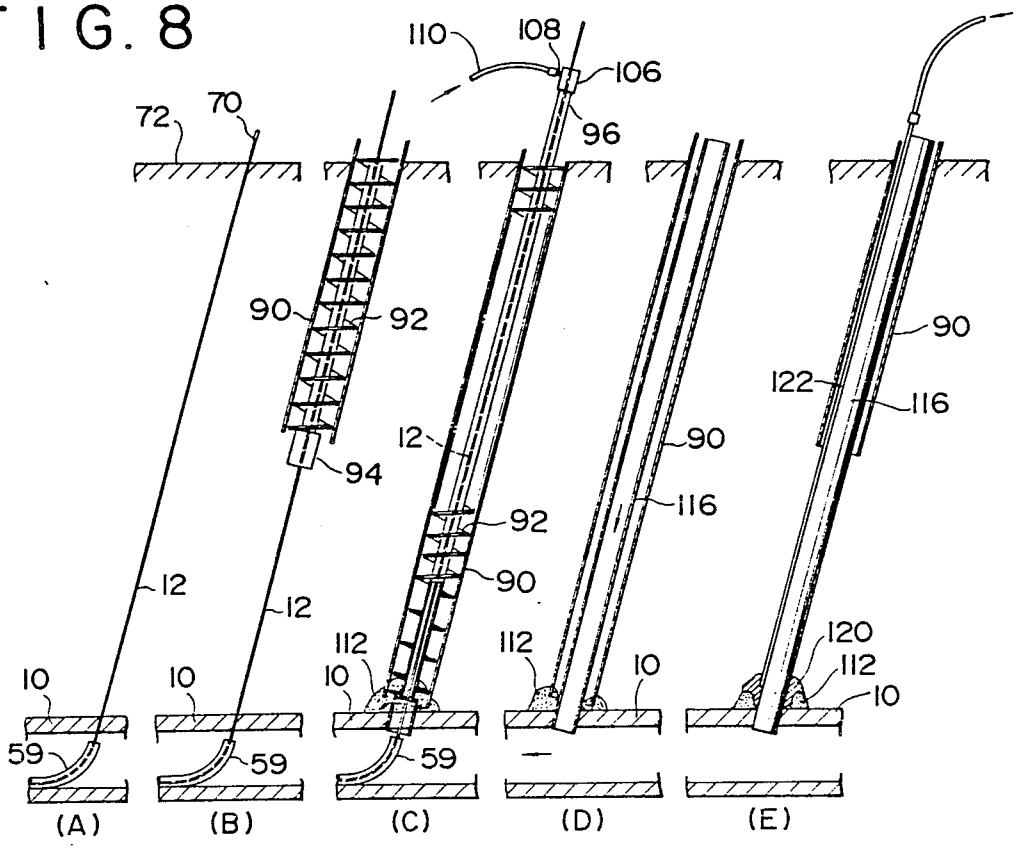
FIG. 8 is a view for explaining a process until a mounting pipe is positioned.

As a result, the rod 12 repeats intermittently the process of rotating about its axis while advancing. By so doing, the rod 12 penetrates the wall member of the main pipe 10 so as to be propelled toward the ground surface. As shown in FIG. 8(A), the tip of the rod 12 finally projects upward from the ground surface 72. The rod 12 can be advanced straight through its rotation with high speed.

Figure 9:
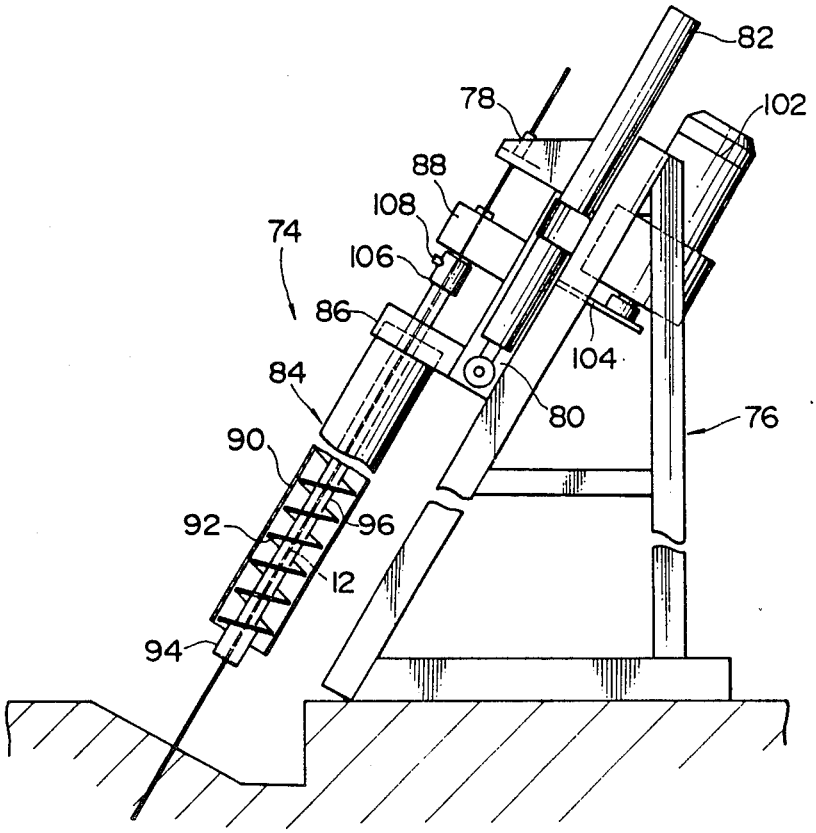
FIG. 9 is a front view showing an embodiment of an excavating machine used in the present invention.

As shown in FIG. 9, an excavating machine 74 is installed on the ground, which utilizes the rod 12 extending from the main pipe 10 as a guide while excavating a hole from the tip side of the rod 12 toward the main pipe 10.

The excavating machine 74 comprises a chuck 78 fixed to the upper portion of a support bed 76 so as to releasably clamp the tip of the rod 12 protruding above on the ground. The support bed 76 supports a slider 80 to be movable parallel to the rod 12. The slider 80 is moved by a cylinder mechanism 82 mounted on the support bed 76.

An excavating mechanism 84 for drilling a hole along the rod 12 is removably mounted on the slider 80 by fittings 86, 88. The excavating mechanism 84 in the embodiment shown in the drawing is an earth auger provided with a tubular casing 90, a screw conveyer 92 received rotatably in the casing and a cutter 94 mounted on the tip of the screw conveyer. However, a different type of excavating mechanism may be applied to the present invention.

Figure 10:
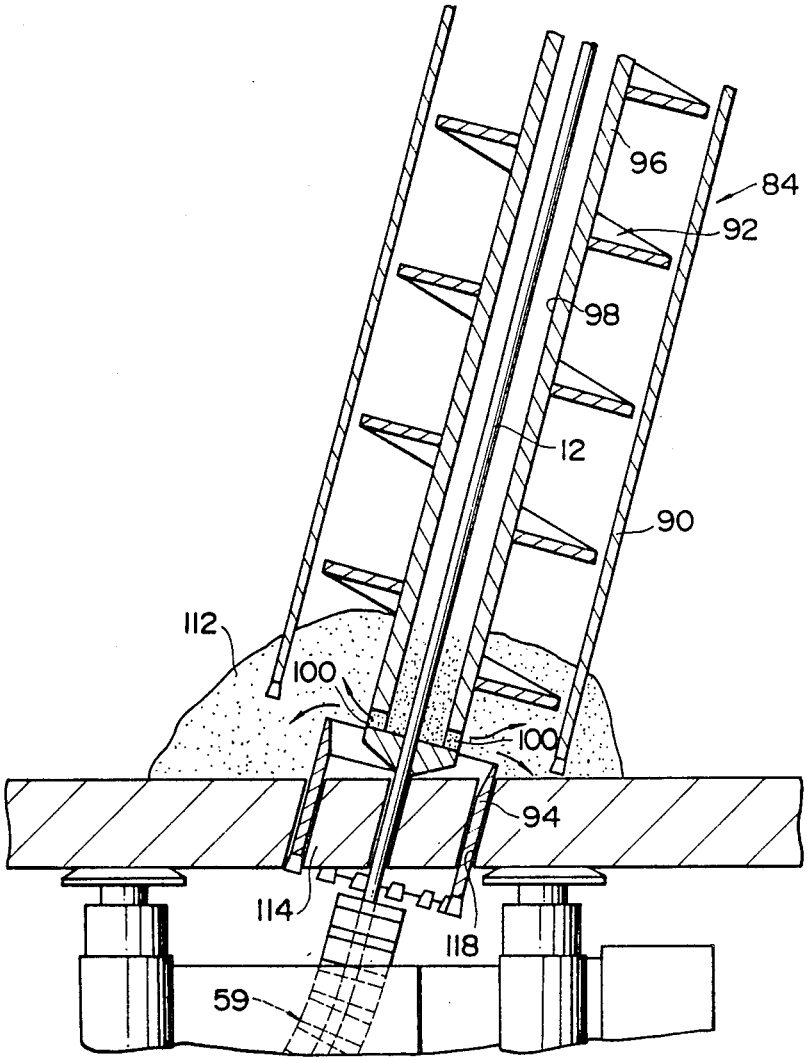
FIG. 10 is an enlarged-scale view showing the excavating machine under the final process of excavation.

As clearly shown in FIG. 10, a shaft 96 of the screw conveyer 92 has a through hole 98 extending through the shaft 96 along the axis thereof so as to rotatably receive rod 12. Also, the lower end of the through hole 98 constitutes a small hole, through which the rod 12 passes and communicates to the outside through a plurality of holes 100 extending radially about shaft 96.

As seen in FIG. 9, the casing 90 and the shaft 96 are supported rotatably about the axis of the rod 12 by fittings 86 and 88, respectively. Also, the rotation of a motor 102 supported by the support bed 76 is transmitted through a chain 104 to the shaft 96.

In excavation, after the tip of the rod 12 is first inserted into the hole 98 of the excavating machine 84, the tip of the rod 12 is clamped by the chuck 78 so as to tension the rod 12. At this time, the chuck 36 of the rod propeller 14 is operated to clamp the rod 12.

In this state, the motor 102 is operated and the cylinder mechanism 82 is expanded. Accordingly, when the screw conveyer 92 is rotated about the axis of the rod 12 while being advanced, the casing 90 is advanced together with the screw conveyer 92. As shown in FIG. 8(B), the excavating mechanism 84 is then advanced along the rod 12 and finally the tip of the excavating mechanism 84 reaches the main pipe 10 as shown in FIG. 8(C) and FIG. 10. Consequently, a portion of the wall of the main pipe 10 is cut off by the cutter 94.

The hole excavated as above mentioned reaches accurately to the main pipe 10 since the excavating mechanism 84 is advanced by the guidance of the rod 12. Therefore, the accurate hole can be easily excavated.

In laying the mounting pipe, a cap 106 is first mounted on the upper end of the shaft 96 to close the hole 98 of the shaft 96 at the upper end of the shaft 96. As shown in FIG. 9, the cap 106 may be mounted before the excavation. The cap 106 has a nipple 108 communicating to the hole 98 in the shaft 96.

Next, as shown in FIG. 8(C), a hose 110 is connected to the nipple 108 and seal agent 112 is poured from the hose 110. As shown in FIG. 10, the seal agent 112 flows out of the hole 98 through the holes 100 to close a gap between the casing 90 and the main pipe 10.

Then, after the screw conveyer 92 is removed together with cut pieces 114 of the main pipe 10, as shown in FIGS. 8(D) and 10, the lateral sewer or mounting pipe 116 is inserted into the casing 90 until the tip of the mounting pipe 116 is fitted in a hole 118 bored in the main pipe 10. The mounting pipe 116 may be inserted either manually or mechanically.

Thereafter, the chuck of the excavating machine 74 releases the rod 12. Then, the rod 12 is drawn back by the rod propeller 14, and the rod propeller 14 is removed. The rod 12 can be drawn back by the operating mechanism 21 of the rod propeller 14. In particular, the rod 12 can be drawn back by repeating the process of drawing back the claws 42 while clamping the rod 12, and advancing the claws 42 while releasing the rod 12.

Next, as shown in FIG. 8(E), seal agent 120 is poured from a thin pipe 122 into the outer periphery of the bottom of the mounting pipe 116, and then the casing 90 is removed. After the removal of the casing 90, earth and sand are poured into the gap between the casing 90 and the mounting pipe 116. Thus, the mounting pipe 116 is stabilized.

Further, the present invention can be applied not only to the method and apparatus for excavating holes used for laying a mounting pipe 116, but also for example, to a method and apparatus for excavating holes used for laying a pipe extending from one shaft to another shaft and holes for other purpose.

What is claimed is:

1. An excavating machine utilizing a rod having a tip end portion extending from a space provided in the ground so as to act as a guide while excavating a hole from the tip end portion of said rod toward said space, comprising:

means located at the tip end portion for clamping the tip end portion of said rod;

excavating means disposed coaxially about said rod so as to advance toward said space along said rod;

drive means for rotating said excavating means around said rod while advancing said excavating means along said rod; and means for supporting said clamping means, excavating means and drive means.

2. A machine for excavating a hole as claimed in claim 1, wherein it further comprises a tubular casing advanced together with said excavating means by said drive means; and wherein said excavating means is an earth auger provided with a screw conveyer received in said casing so as to be rotatable around the axis of said casing and having a hole extending along the rotary axis so as to receive said rod.

3. A method for excavating a hole for communicating between a first space provided in the ground and a second space apart from the first space, comprising steps of:

rotating a rod about its axis while advancing the rod from the first space to the second space so that said rod may be disposed to extend between the first and the second spaces; and excavating the ground by excavating means advanced along said rod from the side of said second space to said first space while utilizing said advanced rod as a guide and maintaining said rod to extend through the first and second spaces.

4. A method for excavating a hole claimed in claim 3, wherein said rod is guided along a curved path in said first space.

5. A method for excavating a hole claimed in claim 3, wherein said excavating means is advanced, while maintaining said rod in the relative positional relationship between the positions of said rod in the first space and in the second space.

6. A method for excavating a hole claimed 3, wherein said first space is defined by a sewer pipe embedded in the ground and said second space is a space above the ground.

7. A method for excavating a hole claimed in claim 3, wherein said first and second spaces are respectively first and second shafts formed in the ground.

8. An apparatus for excavating a hole for communicating between a first space provided in the ground and a second space apart from the first space comprising:

a rod propelling mechanism for disposing a rod so as to extend between said first and second spaces, said rod propelling mechanism being disposed in said first space and including driving means for advancing said rod from said first space to said second space while rotating said rod around its axis; and an excavating mechanism for excavating the ground from said second space to said first space while maintaining said rod so as to extend between said first and second spaces and utilizing said rod as a guide;

said excavating mechanism having: means for clamping a tip end portion of said rod; excavating means disposed so as to extend along said rod; and rotation means for advancing the excavating means along said rod from said second space to said first space while rotating the excavating means around its axis.

9. An apparatus for excavating a hole claimed in claim 8, wherein said rod propelling mechanism further includes a rod guiding means guiding said rod so that said rod penetrates a wall member defining said first space.

10. An apparatus for excavating a hole claimed in claim 8, wherein said rod propelling mechanism further includes: rod guiding means placed in front of said driving means for guiding said rod along a curved path; and means for supporting said driving means and said guiding means.

11. An apparatus for excavating a hole claimed in claim 10, wherein said curved path is a through hole formed in said guide means so as to permit said rod to penetrate same.

12. An apparatus for excavating a hole claimed in claim 11, wherein said guide means has a plurality of bearings and a plurality of spacers disposed alternately along said curved path so as to define said curved path.

13. An apparatus for excavating a hole claimed in claim 10, wherein said driving means comprises:

a pair of guides supported by said support means and extending parallel along said rod from said support means;

a slider supported by said guides so as to be movable along the guides;

a chuck journalled by said slider so as to be rotatable about the axis parallel to said guides and having a through hole extending in the direction of said axis so as to receive said rod;

first drive means for rotating said chuck;

second drive means for moving said sliders back and forth along said guides; and third drive means for operating said chuck so that said chuck clamps said rod and releases said rod.

* * * * *

UNITED STATES PATENT AND TRADEMARK OFFICE

CERTIFICATE OF CORRECTION

PATENT NO. : 4,869,619

DATED : September 26, 1989

INVENTOR(S) : Toshio Akesaka

It is certified that error appears in the above—identified patent and that said Letters Patent is hereby corrected as shown below:

Title Page:

Abstract, line 1-2, delete "therefore", and insert --therefor--.
Abstract, line 15, delete "a".
Column 1, line 16, delete "the" (first occurrence).
Column 2, line 39, delete "a" (first occurrence), and insert --an--.
Column 3, line 27, after "jack" add --32--.
Column 3, line 28, delete "slides", and insert --slider--.
Column 3, line 28, delete "the" (first occurrence).
Column 4, line 34, delete "to", and insert --of--.
Column 4, line 62, delete "on".
Column 6, line 53, after "claimed" add --in claim--.

Signed and Sealed this

Eighteenth Day of September, 1990

*Attest:*

HARRY F. MANBECK, JR.

*Attesting Officer*

*Commissioner of Patents and Trademarks*